United States Patent [19]

Hammer et al.

[11] 4,316,121

[45] Feb. 16, 1982

[54] INTEGRALLY BALLASTED FLUORESCENT LAMP UNIT

[75] Inventors: Edward E. Hammer, Mayfield Village; Eugene Lemmers, Cleveland Heights, both of Ohio

[73] Assignee: General Electric Company, Schenectady, N.Y.

[21] Appl. No.: 90,500

[22] Filed: Nov. 1, 1979

[51] Int. Cl.[3] ..... H01J 7/44; H01J 17/34; H01J 19/78; H01J 23/16

[52] U.S. Cl. ..... 315/62; 315/DIG. 5; 315/52; 315/71; 315/58

[58] Field of Search ..... 315/62, 71, 58, 283, 315/DIG. 5, 53, 104, 44, 45, 46, 49, 52, DIG. 2, DIG. 4; 338/20

[56] References Cited

U.S. PATENT DOCUMENTS

| | | | |
|---|---|---|---|
| 2,301,670 | 11/1942 | Abadie | 315/53 |
| 3,974,418 | 8/1976 | Fridrich | 315/DIG. 5 |
| 3,996,493 | 12/1976 | Davenport et al. | 315/58 |
| 4,178,535 | 12/1979 | Miller | 315/54 |
| 4,208,616 | 6/1980 | Moerkens | 315/283 |

FOREIGN PATENT DOCUMENTS

| | | | |
|---|---|---|---|
| 716810 | 1/1942 | Fed. Rep. of Germany | 315/DIG. 5 |
| 618256 | 2/1949 | United Kingdom | 315/DIG. 5 |
| 738573 | 10/1955 | United Kingdom | 315/DIG. 5 |
| 761688 | 11/1956 | United Kingdom | 315/DIG. 5 |

*Primary Examiner*—Saxfield Chatmon, Jr.
*Attorney, Agent, or Firm*—Norman C. Fulmer; Lawrence R. Kempton; Philip L. Schlamp

[57] ABSTRACT

An integrally connected fluorescent lamp and ballast unit having an elongated ballast of wire wound around and along an elongated magnetizable core and extending alongside an elongated lamp bulb. The elongated lamp and ballast can be straight, or can be curved. The ballast provides a combined resistive and inductive ballasting impedance for the lamp.

2 Claims, 5 Drawing Figures

21
12'
12
12'
11
11'
17
13
11'
14
16

21
25
38
22
23
24
26

12
22

4
28
19
37
33
36
31
32
13
4
12

18

41
21
42
36
37
38
33
31
32
19
13

INTEGRALLY BALLASTED FLUORESCENT LAMP UNIT

BACKGROUND OF THE INVENTION

The invention is in the general field of gas discharge lamp units, such as fluorescent lamp units, and more specifically portable lamp units.

Gas discharge lamps, such as fluorescent lamps, comprise an elongated bulb which may be straight or curved and which contain discharge electrodes near the ends thereof and a suitable exciting vapor such as mercury in combination with an inert filing gas such as argon. A ballast must be provided for limiting the operating discharge current in the lamp, and to supply the proper current for preheating the electrodes at starting. The starting is accomplished by using a switch, automatic or manual, which causes current to flow thru the electrodes resulting in proper starting of the discharge.

U.S. Pat. No. 2,301,670 to Abadie discloses fluoresent lamp units having a reactive type of ballast such as an inductor or a capacitor, and U.S. Pat. No. 3,996,493 to Davenport et al. discloses a resistance-ballasted fluorescent lamp unit.

SUMMARY OF THE INVENTION

Objects of the invention are to provide an improved discharge lamp unit, and to provide such a lamp unit with an improved ballast construction which incorporates the advantageous features of both inductive ballasting and of resistive ballasting within the same unit.

The invention comprises, briefly and in a preferred embodiment, a gas discharge lamp unit having a combination inductive-resistive ballast. Preferably the lamp has an elongated bulb and the ballast comprises wire wound around and along an elongated magnetizable core and extends alongside the bulb. The elongated bulb and ballast can be straight, or can be curved. The type and size of the wire for the winding are chosen to provide both the resistance and inductance in a single component, resulting in compactness, reduced weight, and a cost saving over separate component parts. Each of the resistive and inductive components of the ballast provides a substantial amount of the ballasting. Preferably these components are about equal, or the inductive component is slightly larger than the resistive component. With the combined resistive and inductive components in the ballast, the resistive component permits a reduction in size and weight of the ballast and the inductive component improves the operating current waveform, efficacy and lamp starting characteristics.

DESCRIPTION OF THE PREFERRED EMBODIMENT

Figure 1:
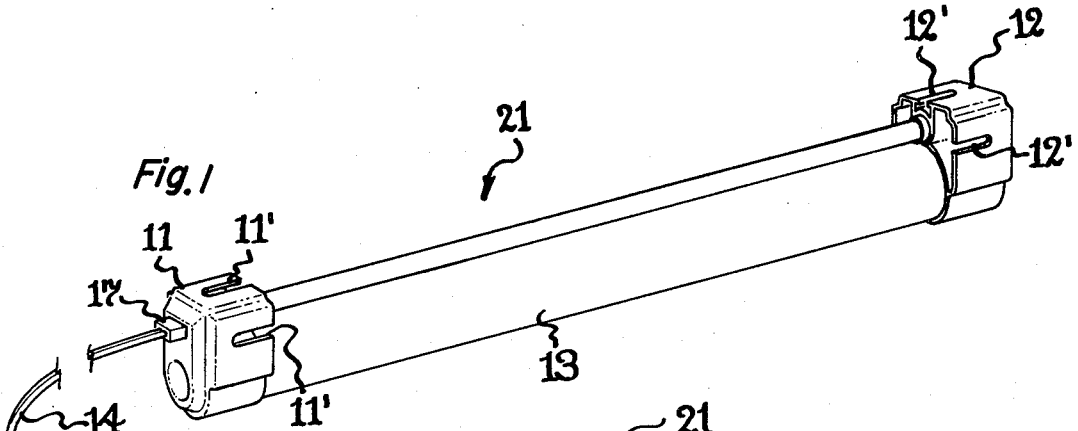
FIG. 1 is a perspective view of a fluorescent lamp discharge unit in accordance with the preferred embodiment of the invention.
Figure 2:
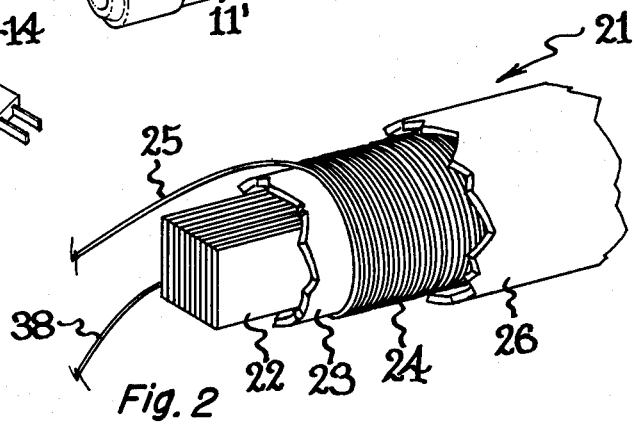
FIG. 2 is a broken away perspective view of a portion of the ballast of the lamp unit.
Figure 4:
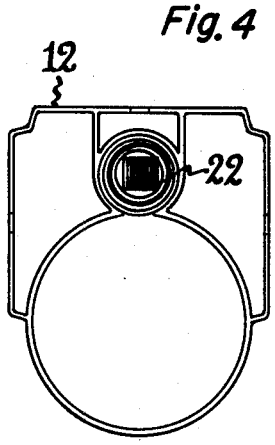
FIG. 4 is a cross-sectional view taken on the line 4—4 of FIG. 3.

A pair of end caps 11 and 12 are provided over or against the ends of an elongated gas discharge device 13 such as a fluorescent lamp. An electrical power cord 14 extends from one of the end caps 11, and consists of a plug 16 at one end and a connector 17 at the other end which plugs onto a pair of connector terminal pins 18 and 19 in the end cap 11. The power cord 14 may incorporate an on/off switch. Attachment openings 11', 12' are provided at the sides of the end caps 11, 12.

In accordance with the invention, the lamp unit is provided with a unitary inductive-resistive ballast 21 which in a preferred embodiment comprises an elongated magnetizable core 22 which may be a laminated core of iron or steel strips. A cylindrical winding form 23 surrounds the core 22 and is made of insulative material. A winding 24 of insulated wire 25 is formed around and along the winding form 23, and is surrounded by a protective cover 26 of insulated material. The ends of the ballast 21 extended into openings in the end caps 11 and 12 and may be cemented therein or resiliently held by means of rubber bushings 27 and 28.

Figure 3:
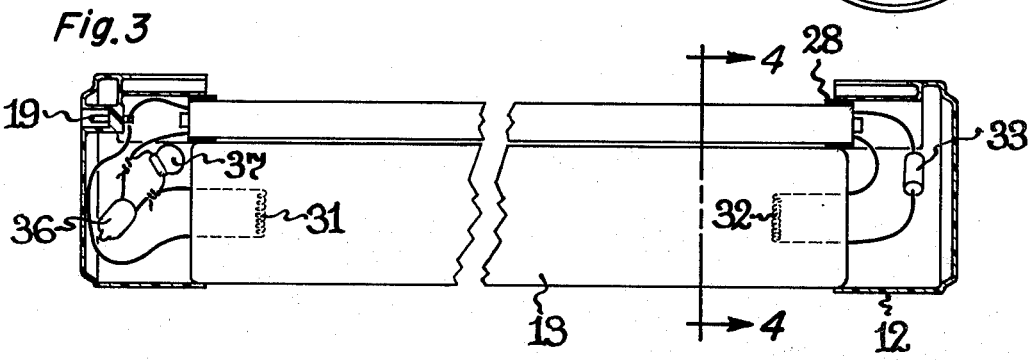
FIG. 3 is a side view of the lamp unit, showing internal parts.
Figure 5:
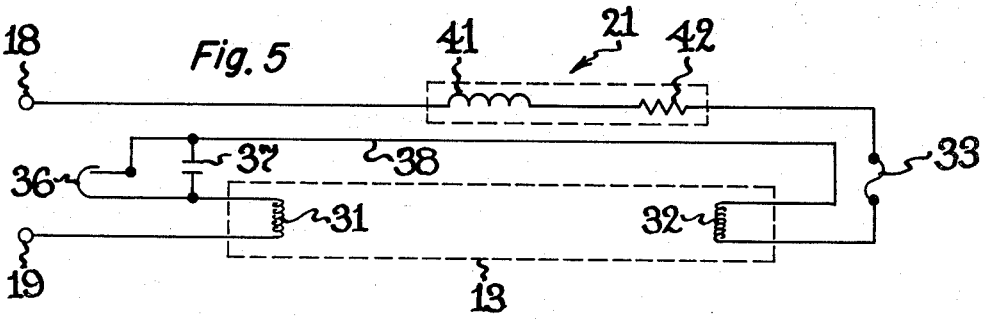
FIG. 5 is an electrical schematic diagram of the lamp unit.

As shown in FIGS. 3 and 5, the lamp 13 is provided with coiled filaments 31 and 32 respectively near the ends thereof. The electrical power terminal 18 is connected to an end of the filament 32, via the ballast 21 and a fuse 33, and the power terminal 19 is connected to an end of the other filament 31. A conventional glow starter switch 36, which is conventionally shunted by a capacitor 37, is connected between the remaining ends of the filaments 31, 32. In the embodiment shown, the starter switch 36 and capacitor 37 are positioned in the end cap 11, and the fuse 33 is contained in the end cap 12. A wire 38, which also aids in the starting process because of its proximity to the lamp 13, extends alongside the core 22 and within the winding form 23 connects the starter switch 36 to the filament 32. The core 22 and the number of turns of winding 24 are chosen to provide a substantial inductive component 41 of the ballast 21, while at the same time the type and size of wire 25, and the number of turns and diameter of winding 24 are chosen to provide a substantial resistive component 42 in the ballast 21.

The starter switch 36 is normally open, and closes when power is applied to the input terminal 18, 19, such as 120 V at 60 hertz, and current flow through the filaments 31, 32 via the ballast 21, fuse 33, and starter switch 36, thus preheating the filaments to facilitate initiation of a glow discharge in the mercury vapor filling of the bulb 13. After one or two seconds of filament preheat, the starter switch 36 opens, thereby interrupting the current flow in the ballast 21 and thus causing an inductive voltage kick to be generated in the inductive component 41, which facilitates the starting of a glow discharge in lamp 13. The operating current of the glow discharge is then controlled and limited by inductive and resistive ballast components 41 and 42.

In a successful embodiment of the invention, the bulb 13 was a conventional 20 watt fluorescent light bulb approximately 2 feet long, and the ballast 21 comprised a core 22, $\frac{1}{4}$ inch wide, $\frac{1}{4}$ inch thick, and about 24 inches long, and the winding 24 comprised about 3,400 turns of #33 gauge insulated copper wire. This provided a resistance 42 of about 75 ohms, and an inductive component 41 of about 240 millihenries which at 60 hertz has a reactance of about 90 ohms. Preferably the ballast 21 is made relatively long, such as the length of the lamp 13, to facilitate radiation dissipation of heat generated in the resistive component 42.

To achieve the invention's advantageous combination of inductive and resistive ballasting of a lamp, each of the inductive and resistive components 41 and 42 should be designed to contribute a substantial amount toward the overall ballasting, for example each of these components should contribute at least one-fourth to the total ballasting. The exact values of the two ballast components can be chosen based on the criteria that increasing the resistive component 42 permits a reduction of size, weight and cost of the ballast (of particular importance in a self-ballasted lamp unit), and increasing the reactance of the inductive component 41 improves operating lamp life, efficacy and lamp starting.

While preferred embodiments of the invention have been shown and described, various other embodiments and modifications thereof will become apparent to persons skilled in the art and will fall within the scope of the invention as defined in the following claims.

What we claim as new and desire to secure by United States Letters Patent is:

1. A ballasted discharge lamp unit comprising a ballast connected in series with an elongated discharge lamp, said ballast comprising an elongated magnetizable core wound with a single winding which provides both inductive and resistive components of total ballast impedance, said ballast being positioned alongside and extending along substantially the entire length of said lamp, said inductive and resistive components being of such values that each contributes substantially to the ballasting of the discharge lamp when operating to produce light.

2. A lamp unit as claimed in claim 1, in which each of said inductive and resistive components contributes at least one-fourth to the total ballasting of the lamp.

* * * * *